US005295460A

United States Patent [19]

Döhring et al.

[11] Patent Number: 5,295,460

[45] Date of Patent: Mar. 22, 1994

[54] HYDRAULIC VALVE PLAY EQUALIZATION ELEMENT

[75] Inventors: Klaus Döhring, Heidelberg; Wolfgang Krause, Waibstadt, both of Fed. Rep. of Germany

[73] Assignee: Firma Carl Freudenberg, Weinheim/Bergstr, Fed. Rep. of Germany

[21] Appl. No.: 12,687

[22] Filed: Feb. 3, 1993

[30] Foreign Application Priority Data

Feb. 11, 1992 [DE] Fed. Rep. of Germany ..... 4203897

[51] Int. Cl.[5] ..... F01L 1/24

[52] U.S. Cl. ..... 123/90.58; 123/90.55; 74/569

[58] Field of Search ..... 123/90.48, 90.51, 90.55, 123/90.58, 90.59; 74/569

[56] References Cited

U.S. PATENT DOCUMENTS

| | | | |
|---|---|---|---|
| 4,686,947 | 8/1987 | Speil | 123/90.58 |
| 4,715,334 | 12/1987 | Buente | 123/90.58 |
| 4,779,583 | 10/1988 | Laffter et al. | 123/90.58 |
| 4,798,180 | 1/1989 | Okabe et al. | 123/90.58 |
| 4,815,425 | 3/1989 | Deuring et al. | 123/90.58 |
| 4,825,824 | 5/1989 | Deuring et al. | 123/90.58 |
| 5,022,361 | 6/1991 | Schut | 123/90.58 |
| 5,107,806 | 4/1992 | Dohring et al. | 123/90.58 |
| 5,119,774 | 6/1992 | Krieg et al. | 123/90.55 |
| 5,159,907 | 11/1992 | Budde | 123/90.55 |

FOREIGN PATENT DOCUMENTS 3506730 4/1986 Fed. Rep. of Germany .

*Primary Examiner*—E. Rollins Cross
*Assistant Examiner*—Weilun Lo
*Attorney, Agent, or Firm*—Kenyon & Kenyon

[57] ABSTRACT

A hydraulic valve play equalization element for the valve drive of an internal combustion engine is disclosed. The equalization element comprises an inner tappet and an outer tappet arranged to move relative to one another in the axial direction. The outside tappet is formed by an essentially cup-shaped housing with a level bottom and the inside tappet and the outside tappet delimit an oil-filled storage space which is sealed towards the outside and which can change in volume. A displacement element to equalize volume changes is enclosed in the storage space. The outside tappet is formed by an essentially tube-shaped mantle of thermoplastic material, which has slide surfaces radially inside and outside. The mantle is closed off with a fluid seal, by a disk structured as an expeller, in the direction of a cam shaft that is used. The inside slide surface encloses the inside tappet, resting against its circumference, and forming a fluid seal.

11 Claims, 1 Drawing Sheet

HYDRAULIC VALVE PLAY EQUALIZATION ELEMENT

Figure 1:
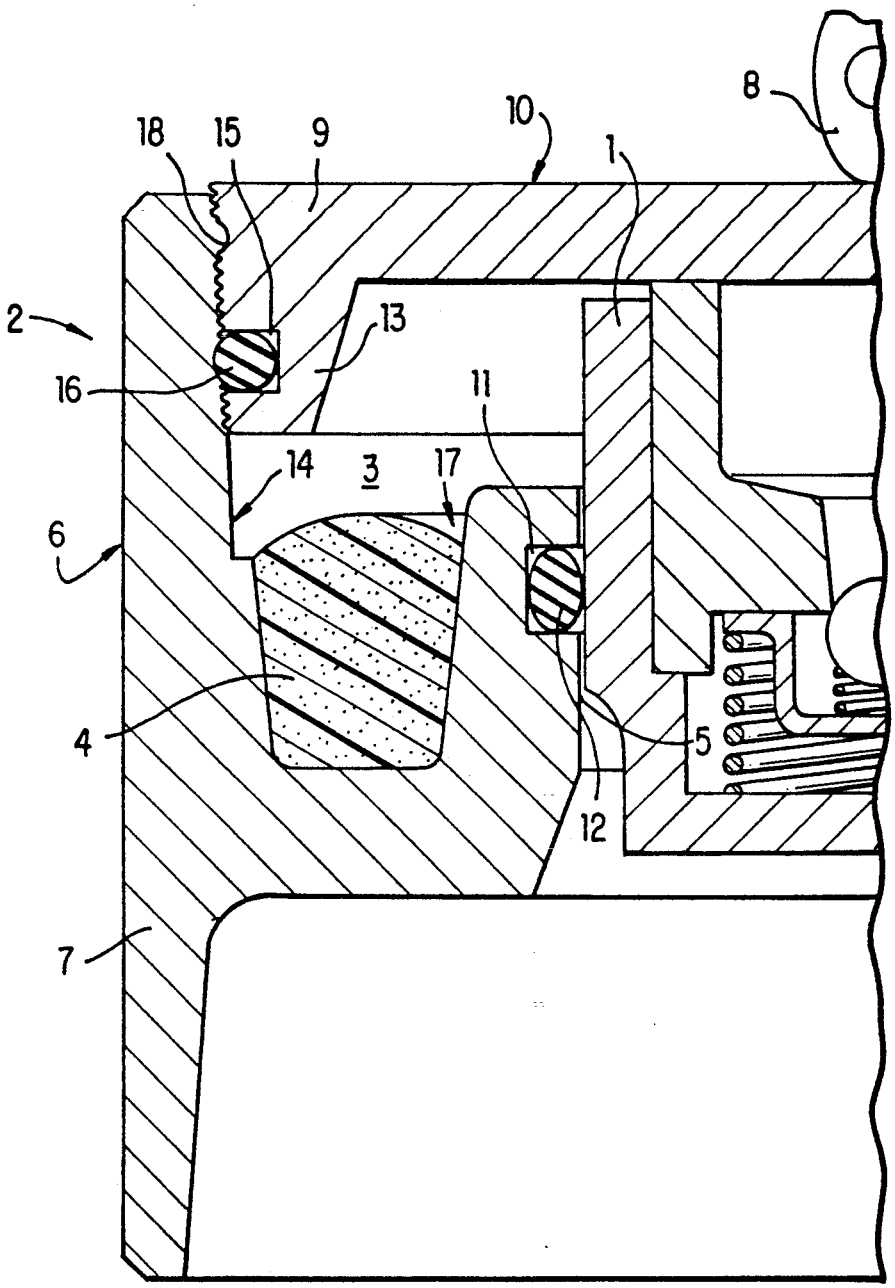

The present invention relates to a hydraulic valve play equalization element for the valve drive of an internal combustion engine. The equalization element comprises an inner tappet and an outer tappet, which are arranged to move relative to one another in an axial direction. The outer tappet is formed by an essentially cup-shaped housing with a level bottom. The inside tappet and the outside tappet delimit an oil-filled storage space which is sealed towards the outside and which can change in volume. A displacement element to equalize volume changes is enclosed in the storage space.

A valve play equalization element is shown in DE-OS 35 06 730. The storage space contained in this element is closed off towards the outside by a bellows seal. This previously known hydraulic valve play equalization element is not very satisfactory in terms of ease of production. Also, assembly of the individual components of this hydraulic valve play equalization element is complicated and time consuming.

The present invention provides a valve play equalization element for the valve drive of an internal combustion engine, which is inexpensive to produce, in which the assembly sequence is much easier than the element described in DE-OS 35 06 730, and which consists of few individual parts.

In the hydraulic valve play equalization element for the valve drive of an internal combustion engine of the present invention, the outside tappet is formed by a tube-shaped mantle made of thermoplastic material. The tube-shaped mantle has slide surfaces at least in partial regions on its inside and outside radial surfaces. The interior of the mantle is closed off with a fluid seal between a disk structured as an expeller located in the direction of a cam shaft which drives the valve. The inside slide surface encloses the inside tappet, which rests against its circumference, and forms a fluid seal.

The present invention is advantageous in that the assembly sequence of the valve play equalization element is much more efficient and is significantly simplified, due to the structure of the individual parts to be connected. The displacement element can be inserted into the tube-shaped mantle, which is initially open in at the end to be placed nearest the cam shaft. The inside slide surface of the mantle encloses the inside tappet, which rests against the inside slide surface's inner circumference and forms a seal. This is accomplished by inserting the inside tappet into the mantle from above. Subsequently, the storage space, which is closed off at the bottom and has a fluid seal on the side facing away from the cam shaft, is filled from above with oil. The disk, which acts as an expeller, is subsequently inserted into the mantle. A vent bore can be provided for venting and for precise adjustment of the resulting inside pressure. The bore is closed off after assembly is complete, for example with a ball, to form a fluid seal.

Pursuant to an advantageous development, the disk can consist of metallic material and can have a hardened surface in the direction of the cam shaft. The hardened surface of the disk results in low wear over a long lifetime. The disk, which is subsequently inserted into the plastic mantle which forms a component of the outside tappet, can be heated, for example, to a temperature which causes the thermoplastic material of the mantle to melt at the surface facing the disk, before being inserted, so that the disk is reliably held in place after cooling. Another manner of fixing the disk in place to the mantle is to insert the disk into the mantle first, and then to irradiate the mantle with ultrasound until a secure bond between the mantle and the disk has been achieved. According to another development, the disk can consist of ceramic material.

To allow for movement of the outside tappet and the inside tappet relative to one another, and to provide a fluid seal, the inside slide surface of the outside tappet can have a groove on the circumference. This groove is open in the direction of the inside tappet. Within this groove a seal ring can be arranged, so that the seal ring touches the inside tappet with radial pre-stress, forming a seal during use. The seal ring can be formed, for example, by an O-ring. O-rings are easily available in a wide variety of sizes, in large numbers, at low cost, which is of particular importance with regard to economical production of the valve play equalization element according to the present invention.

Simple and reliable fixing of the disk to the mantle during the entire period of use of the valve play equalization element can be ensured if, along the disk's circumferential limit, the disk has a collar projecting axially in the direction of the storage space. This collar touches the inside surface of the mantle, forming a seal. The collar can be knurled in the region of its outside circumference, causing it to tightly engage with the inside of the plastic mantle. In addition or alternatively, the collar can have a groove along its outside circumference, opened in the direction of the mantle, in which a seal ring, preferably an O-ring of an elastomeric material, is arranged. The seal ring touches the inside surface of the mantle with radial pre-stress, forming a seal. When inserting a heated disk into the thermoplastic mantle, the engagement effect between the contact surfaces is promoted. An additional safety measure to prevent fluid loss from the closed storage space during a long period of use is guaranteed, for example, by the use of an O-ring which closes the separation joint under radial pre-stress, forming a contact seal.

To provide for simplified assembly, the mantle and the collar can be conically structured in the region of their reciprocal contact surfaces, in such a way that the contact surfaces increase in diameter in the direction of the cam shaft. With this feature, the disk can be inserted into the circular opening of the mantle until a precisely defined pressure force has been reached. Also, the disk and/or the mantle can have holder lugs and/or positioning projections on the circumferential surfaces which face each other, which engage each other precisely and/or make contact when the final position of the disk within the mantle has been reached.

The displacement element can be formed by a closed-cell soft foam, which is partially arranged in a recess of the outside tappet within the storage space. The displacement element and the recess can be at least partially glued together. For example, the displacement element can consist of a soft polyurethane foam with a density of 30 to 700 kg/m$^3$, where practical, if it is produced such that an essentially pore-free surface is obtained. Diffusion of oil components into the pores of the soft foam element, which are sealed off on the outside surface in balloon manner, is prevented. This arrangement promotes the achievement of excellent usage properties during a particularly long period of use.

If the displacement element and the recess are at least partially glued together, the additional advantage is obtained that direct wetting of the displacement element by the oil contained in the storage space is not possible in the region of the glued zone. The corresponding zone of the displacement element is therefore protected against physical and/or chemical effects of the oil contained in the storage space.

The object of the present invention will be explained further in the following, on the basis of the attached drawing.

FIG. 1 shows an embodiment of the valve play equalization element according to the invention, in a schematic and cross-sectional view.

The hydraulic valve play equalization element for a valve drive of an internal combustion engine shown in FIG. 1 includes an inner tappet 1 and an outer tappet 2, which are arranged to move relative to one another in the axial direction. In the position shown in the drawing, the inner tappet 1 and the outer tappet 2 are arranged relative to one another in such a way that the oil-filled storage space 3, which is sealed towards the outside, has the smallest possible volume. During use of the play equalization element, the inside tappet 1 would have a greater distance from the level bottom of the outside tappet 2 in the axial direction, and can move in both axial directions. In the element shown in FIG. 1, the outside tappet 1 is formed of two parts: a disk 9 of metallic or ceramic material, which forms the level bottom in the direction of the cam shaft 8, and an essentially tube-shaped mantle 7, which can be moved in guides of a cylinder head (not shown) on its outside circumference. The storage space is sealed towards the outside and is filled with oil before the initial use of the valve play equalization element. To equalize volume changes, a displacement element 4 is arranged within the storage space 3; in this example, it consists of closed-cell soft foam. The displacement element 4 is arranged in a recess 17 of the outside tappet 2 and is partially glued to it. The displacement element 4 can also contain a gas-filled cavity which is formed, for example, by a flexible and/or elastically deformable gas bubble.

The size of the volume changes to be absorbed by the displacement element 4 is dependent on the volume increase which the oil contained in the valve play equalization element experiences during heating of the internal combustion engine and/or during volume changes which result from a change in the length of the valve play equalization element. A change in the supporting length can occur, for example, if a valve is still in the open position when the internal combustion engine is shut off, and in this case, the set-back spring of the valve is stressed for an extended period of time, which results in a gradual reduction of the supporting length (shown here). When the internal combustion engine is started again, a restoration of the original supporting length is guaranteed after the first few revolutions of the cam shaft 8.

The tube-shaped mantle 7, which can be made of a thermoplastic material, has slide surfaces 5, 6 radially on the inside and outside. The slide surfaces 5, 6 can contain slide rings, for example, depending on the particular conditions of the application case, which end flush with the surface of the slide surfaces 5, 6. The rings can also consist of metallic material, for example, and reduce the wear, particularly in the region of the high-stress zones of the slide surfaces 5, 6 (e.g., in the region of the axial limit), and thus increase the useful lifetime.

The disk 9 has a hardened surface 10 in the direction of the cam shaft 8, and is provided with an inner diameter which increases in the direction of the storage space 3, in the region of its inner circumference. The collar 13 is provided with a knurled edge over its entire axial expanse, which guarantees tight engagement of the disk 9 in the mantle 7. For an additional fluid seal, the contact surfaces of the mantle 7 and the collar 13 are sealed with an O-ring seal 16, which is located within a groove 15 of the collar 13 which is opened in the direction of the mantle 7. The groove 18 in the disk results in increased support in the axial direction.

The depth to which the disk 9 sinks into the tube-shaped mantle 7 can be limited by a radial projection in the mantle 9, on which the disk 9 rests in an axial direction when assembled.

The cam shaft 8 is shown on a greatly reduced scale and schematically in FIG. 1.

We claim:

1. A hydraulic valve play equalization element for a valve drive of an internal combustion engine, comprising:

an inner tappet;

an outer tappet; said inner tappet and said outer tappet being arranged to move relative to one another in an axial direction, the outer tappet being formed in a cup shape with a flattened surface, the inner tappet and the outer tappet delimiting an oil-filled storage space which is sealed towards the outside and which can change in volume, wherein the outer tappet comprises a tube-shaped mantle with inside and outside slide surfaces and a disk closing off said mantle in a fluid-tight manner, the inner tappet sliding in said inside slide surface and forming a fluid seal therewith; and a displacement element to equalize volume changes in the storage space, said displacement element being enclosed in the storage space;

wherein the disk has a collar projecting axially in the direction of the storage space along the circumference of the disk, and wherein a surface of the collar contacts an inside surface of the mantle, forming a seal.

2. The hydraulic valve play equalization element of claim 1, wherein:

the tube-shaped mantle is made of a thermoplastic material.

3. The hydraulic valve play equalization element of claim 1, wherein:

the disk is made of a metallic material and has a hardened surface in the direction of a cam shaft.

4. The hydraulic valve play equalization element of claim 1, wherein:

the disk is made of a ceramic material.

5. The hydraulic valve play equalization element of claim 1, wherein:

the inside slide surface has a groove on its circumference, open in the direction of the inside tappet, in which a seal ring is arranged, the seal ring touching the inside tappet with radial pre-stress to form a seal.

6. The hydraulic valve play equalization element of claim 5, wherein:

the seal ring is an O-ring.

7. The hydraulic valve play equalization element of claim 1, wherein:

the collar is knurled on its outside circumference.

8. The hydraulic valve play equalization element of claim 1, wherein:

the collar has a groove along its outside circumference, opened in the direction of the mantle, in which a seal ring of elastomeric material is arranged, such that the seal ring touches the inside surface of the mantle with radial pre-stress forming a seal.

9. The hydraulic valve play equalization element of claim 1, wherein:

the surfaces of the mantle and the collar which contact each other are conical, in such a way that the contact surfaces have a diameter which increases in the direction of a cam shaft.

10. The hydraulic valve play equalization element of claim 1, wherein:

the displacement element is formed by a closed-cell soft foam, which is partially arranged in a recess in the outside tappet within the storage space.

11. The hydraulic valve play equalization element of claim 10, wherein:

the displacement element and the recess are at least partially glued together.

* * * * *